United States Patent [19]

Murray et al.

[11] Patent Number: 4,917,560

[45] Date of Patent: Apr. 17, 1990

[54] TWIN BIN SELF ERECT SILO

[75] Inventors: Stuart W. Murray, Edmond; Ronald G. Hankins; Thomas E. Bowman, both of Oklahoma City, all of Okla.

[73] Assignee: CMI Corporation, Oklahoma City, Okla.

[21] Appl. No.: 298,741

[22] Filed: Jan. 19, 1989

[51] Int. Cl.[4] ..... B65G 65/32; B65G 67/08; B65G 69/00

[52] U.S. Cl. ..... 414/332; 414/21; 414/523; 414/919

[58] Field of Search ..... 414/332, 21, 919, 523, 414/300, 299

[56] References Cited

U.S. PATENT DOCUMENTS

| | | | |
|---|---|---|---|
| 2,678,738 | 5/1954 | Mangrum | 414/332 |
| 3,092,264 | 6/1963 | Milek | 414/332 |
| 3,438,520 | 4/1969 | Williams | 414/786 |
| 3,586,181 | 6/1971 | Brock | 414/332 |
| 4,268,208 | 5/1981 | Hankins et al. | 414/332 |
| 4,313,708 | 2/1982 | Tiliakos | 414/919 |
| 4,348,146 | 9/1982 | Brock | 414/332 |
| 4,482,281 | 11/1984 | Musil | 414/332 |
| 4,579,496 | 4/1986 | Gerlach | 414/21 |
| 4,728,240 | 3/1988 | Mahr et al. | 414/21 |
| 4,775,275 | 10/1988 | Perry | 414/21 |

*Primary Examiner*—David H. Brown

*Attorney, Agent, or Firm*—Dunlap, Codding, Peterson & Lee

[57] ABSTRACT

A portable, self erect silo for hot mix asphalt having two, side-by-side bins. A single drag slat conveyor directs hot mix asphalt into either bin by use of a single slug feeder pivotally attached to the discharge end of the conveyor.

19 Claims, 8 Drawing Sheets

TWIN BIN SELF ERECT SILO

BACKGROUND OF THE INVENTION

1. Field of the Invention

The present invention relates generally to improvements in silos for storing and dispensing particulate material and, more particularly but not by way of limitation, to improvements in road transportable silos for storing and dispensing hot mix asphaltic concrete.

2. Brief Description of the Prior Art

As has been discussed in U.S. Pat. No. 4,268,208, issued May 19, 1981 to Hankins et al., it has been the practice in the road construction industry to prepare hot mix asphaltic concrete at a location near the road upon which it will be used and to dispense the asphaltic concrete into trucks from a silo which is road transported to the location at which the asphaltic concrete is prepared. By this means, transportation costs associated with the movement of the asphaltic concrete from the site at which it is prepared to the site at which it is to be used can be maintained a reduced level that reduces the cost of building roadways. The Hankins et al. patent teaches a road transportable silo that can be used to store and dispense asphaltic concrete prepared by an on-site hot mix asphaltic concrete preparation apparatus to trucks which deliver the asphaltic concrete from such site.

In addition to being road transportable, modern asphaltic concrete storage and dispensation silos are often provided with another characteristic. It has been found that hot mix asphaltic concrete, in common with other materials composed of particles of varying sizes, tends to segregate if dispensed at a steady rate from a conveyor, used to lift the asphaltic concrete to a level above the bins, into a storage bin. The solution to this problem has been to collect the outflow of the conveyor into a slug which is dropped into the storage bin of the silo in the manner taught in U.S. Pat. No. 3,438,520 issued Apr. 15, 1969 to Williams. With the combination of road transportability and slug feeding, hot mix asphaltic concrete storage and dispersion silos have made an important contribution to the road building industry. However, silos have not kept pace with advances in road building technology. Circumstances have arisen in which prior art silos are not well adapted to the needs of the road building industry. The present invention provides a versatile silo that is well adapted to the needs of the users of hot mix asphaltic concrete.

SUMMARY OF THE INVENTION

In one aspect of the present invention, a silo is provided to enable producers of hot mix asphaltic concrete to meet varying needs that occur in road building projects. In particular, should circumstances arise in which several grades of asphaltic concrete are required in a project, the silo of the present invention provides the asphaltic concrete producer with a capacity to produce, store and dispense these varying grades as they are needed. Alternatively, the silo can be used as a high capacity storage system for a single grade of asphaltic concrete at the selection of the producer of the asphaltic concrete. Thus, the producer of the concrete can tailor his production to meet substantially any conditions that may arise in the field.

To these ends, the silo of the present invention is comprised of a silo main frame that can be placed in raised and lowered positions, for dispersion of asphaltic concrete and road transportability respectively, by a novel elevating system and mounts a plurality of high capacity bins for storing and dispensing a variety of grades of asphaltic concrete. A conveyor is pivotally mounted on the silo main frame for movement between an operating position, in which the conveyor can be used to deliver asphaltic concrete to a point above the bins in the raised position of the silo main frame for deposition into a selected bin, and a transport position in which the conveyor extends along and within upper portions of the silo main frame as well as upper portions of the bins to facilitate transport of the silo. Additional features are provided to facilitate the erection of the silo at the site at which asphaltic concrete is to be used to permit rapid conversion between an erected position of the silo, in which the conveyor is in the operating position and the silo main frame is in the raised position for the storage and dispensation of asphaltic concrete, and a transport position in which the silo main frame is lowered and the conveyor is in the transport position to form a compact structure that can be moved along roadways.

In another aspect of the invention, a novel slug feeder is pivotally mounted on the upper end of the conveyor to deliver asphaltic concrete from the conveyor to any selected bin, thereby preventing segregation of the stored asphaltic concrete. The novel construction of the slug feeder and the mounting of the slug feeder on the conveyor augments both the transportability and asphaltic concrete variability aspects of the invention by permitting slugs to be formed and deposited in any position of the slug feeder, thereby enabling the feeding of any bin, in the erected silo while enabling the slug feeder to be positioned within upper portions of the bins during transport.

An object of the present invention is to provide a versatile asphaltic concrete storage and dispensation silo that is well adapted to substantially any conditions that might be encountered in the field.

Another object of the invention is to enhance the transportability of silos used to store and dispense hot mix asphaltic concrete in road construction projects by providing a silo that can be rapidly moved between a compact transport position and an erected position wherein the silo is configured to dispense hot mix asphaltic concrete.

Yet a further object of the invention is to provide a hot mix asphaltic concrete silo that combines versatility with respect to circumstances of use of the silo with facility of transport from one site of use to another.

Other objects, features and advantages of the present invention will become apparent from the following detailed description when read in conjunction with the drawings and appended claims.

BRIEF DESCRIPTION OF THE DRAWINGS

FIG. 3 is a fragmentary top view in partial cutaway of the silo of FIG. 1 in the transport position of the silo.

DESCRIPTION OF THE PREFERRED EMBODIMENT

Figure 1:
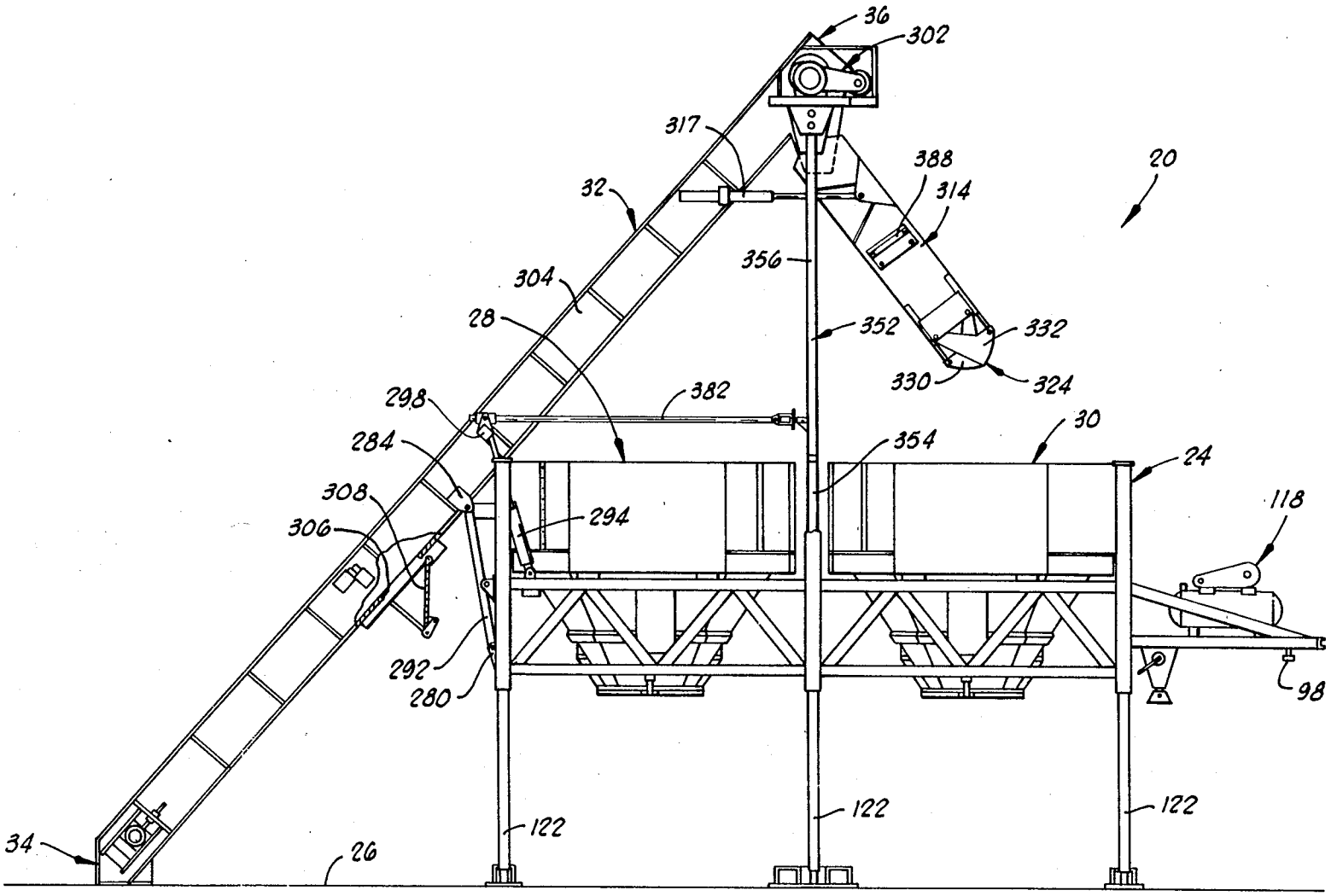
FIG. 1 is a side elevational view in partial cutaway of a hot mix storage and dispensing view constructed in accordance with the present invention in the erected position of the silo.
Figure 2A:
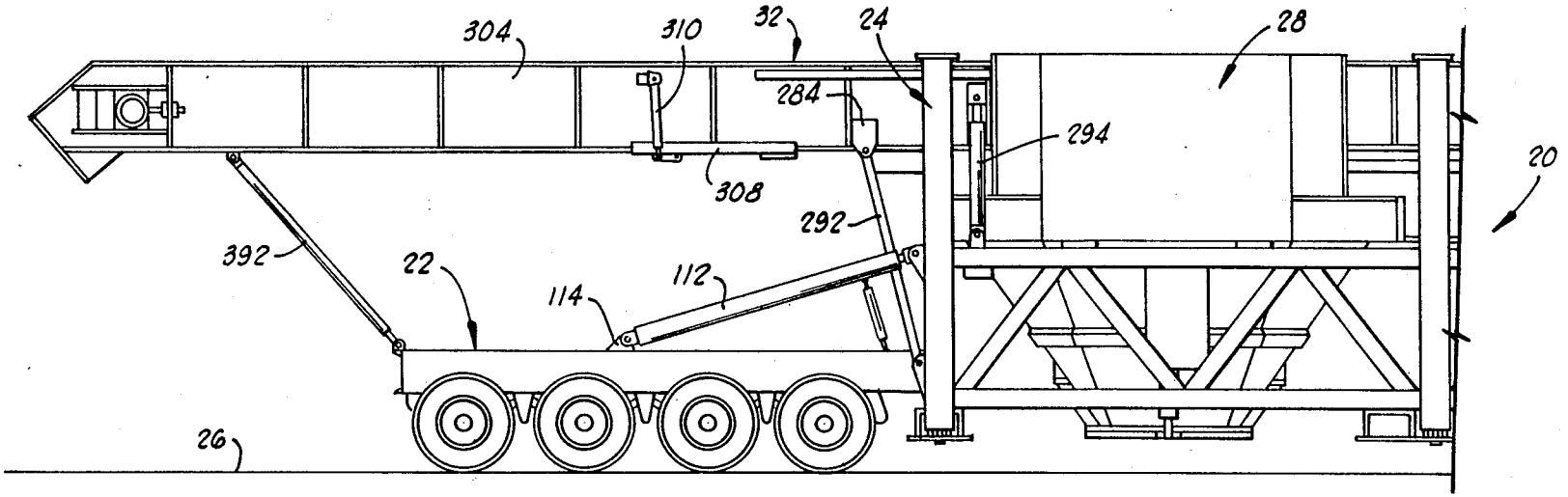
FIGS. 2A and 2B together, make a side elevational view of the silo of FIG. 1 in the transport position of the silo.
Figure 2B:
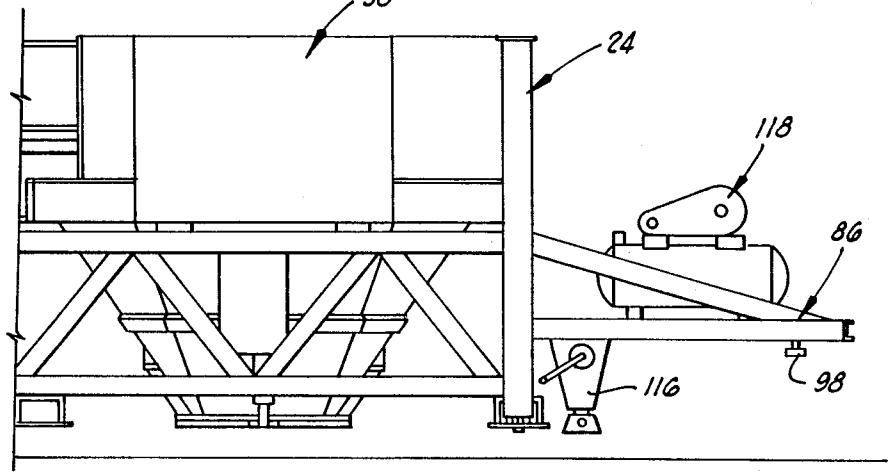

Referring now to the drawings in general and to FIGS. 1 and 2A and 2B in particular, shown therein and designated by the general reference numeral 20 is a self-erecting, road transportable, multiple bin asphaltic concrete storage and dispensing silo constructed in accordance with the present invention. Specifically, FIG. 1 illustrates the silo 20 in an erected position wherein the silo receives hot mix asphaltic concrete from an asphalt mixing apparatus (not shown), stores the concrete, and dispenses the concrete upon demand to trucks (not shown) for delivery to a road building site. FIGS. 2A and 2B illustrate the silo 20 in a transport position in which the silo 20 includes a detachable wheeled dolly 22, of conventional construction, that enables the silo 20 to be moved along roadways via a truck provided with a fifth wheel to a site at which the silo will be emplaced with an asphalt mixing apparatus. In general the silo 20 is comprised of a silo main frame 24 that is placed in a raised position, shown in FIG. 1, at such times that the silo 20 is in the erected position and is placed in a lowered position, shown in FIGS. 2A and 2B at such times that the silo is in the transport position. As shown in these Figures, the silo main frame will thus be at a height above the earth's surface 26 for a purpose that will become clear below in the erected position of the silo 20 while the silo main frame 24 will be adjacent the earth's surface to facilitate road transport in the transport position of the silo 20. First and second bins, 28 and 30 respectively, are supported on the silo main frame 24 in a manner to be discussed below to store and dispense hot mix asphaltic concrete in the erected position of the silo 20 and a conveyor 32 is pivotally mounted on the silo main frame 24 for alternative positioning in an operating position in which the conveyor 32 extends upwardly at a slant from a lower end 34 at the earth's surface 26 to an upper end 36 located above the bins 28 and 30 at such times that the silo 20 is in the erected position shown in FIG. 1 and a transport position in which the conveyor extends horizontally within upper portions of the silo main frame 24 at such times that the silo 20 is in the transport position shown in FIGS. 2A and 2B. For purposes of disclosure, it will be useful to describe the silo main frame 24, the bins 28 and 30, and the conveyor 32 to provide a basis for discussing the general construction of the silo 20 and the manner in which the silo 20 is moved between the erected and transport positions thereof.

Figure 5:
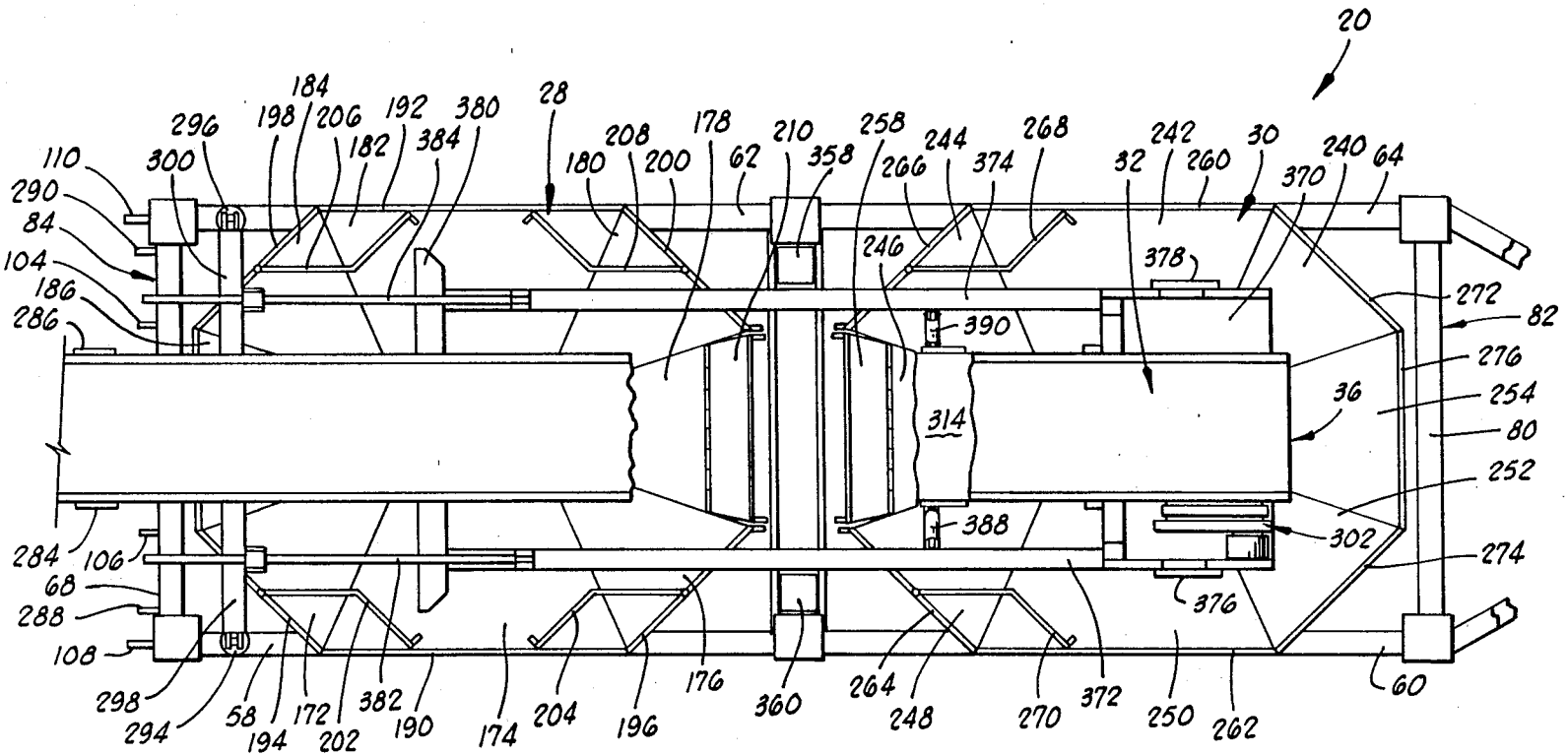
FIG. 5 is an isometric view in partial cutaway of the silo main frame of the silo shown in FIG. 1.

The silo main frame 24 has been particularly illustrated in FIG. 5 to which attention is now invited. As shown therein, the silo main frame 24 is comprised of six vertical posts 38, 40, 42, 44, 46, and 48 which are constructed of square tubing for a purpose to be discussed below and arranged in two parallel rows of three posts each by longitudinally extending bolsters 50, 52, 54, 56, 58, 60, 62, and 64. To this end, the bolsters 50 and 52 are welded between the posts 38 and 40 and 40 and 42 respectively adjacent the bottom of the silo main frame 24; the bolsters 54 and 58 are welded between the posts 44 and 46 and 46 and 48 respectively at the bottom of the silo main frame 24; the bolsters 58 and 60 are welded between the posts 38 and 40 and 40 and 42 respectively at medial portions of the silo main frame 24; and the bolsters 62 and 64 are welded between the posts 44 and 46 and 46 and 48 respectively at medial portions of the silo main frame 24. The bolsters 50 through 64, along with braces (not numerically designated in the drawings) thus provide the silo main frame with two rigid side portions, at opposite sides of the silo, that are interconnected by laterally extending members 66 and 68, between the posts 38 and 44, laterally extending members 70, 72, 74 (FIG. 4), and 76 between the posts 40 and 46, and laterally extending members 78 and 80 between the posts 42 and 48. As shown in FIG. 5, additional bracing at the front end 82 and rear end 84 of the frame 24 can be provided to further contribute to the structural rigidity of the frame 24.

In order to provide for transportability of the silo 20, the silo main frame is provided with a fifth wheel connector 86 that is comprised of tubes 88 through 94 that are welded to the posts 42 and 48 to form a framework extending from the forward end of the silo main frame 24, axle mounting plate 96 and axle 98 (FIGS. 1 and 2A and 2B), that engages the fifth wheel of a towing vehicle, at the forward end of the silo main frame 24. Apertured lugs 104 and 106 are welded to the member 66 at the rear end 84 of the silo main frame to provide a connection to the dolly 22. The forward end of the dolly 22 is similarly provided with apertured lugs (not shown) that mate with the lugs 104 and 106 so that the dolly 2 can be pinned to the silo main frame 24 at such times that the frame 24 is in the lowered position shown in FIGS. 2A and 2B. Stabilization of the connection between the silo main frame 24 and the dolly 22 is provided by apertured lugs 108 and 110, welded to the posts 38 and 44 respectively, to provide for attachment of braces to the posts 38 and 40, one such brace being illustrated in FIGS. 2A and 2B and designated by the numeral 112 therein. The braces connect to lugs welded to the top of the dolly as shown for a lug 114 that attaches to the brace 112. Additional bracing can be provided between the brace 112 and the dolly as has been indicated in FIGS. 2A and 2B. Conventional extensible legs, as the leg 116 shown in FIGS. 2A and 2B, are mounted on the bottom of the fifth wheel connector 86 to permit the silo 20 to be placed in the transport position prior to connection to a towing vehicle and the connector 86 is also utilized to provide a mount for a conventional air compressor and tank assembly 118 used in a manner to become clear below.

Figure 6:
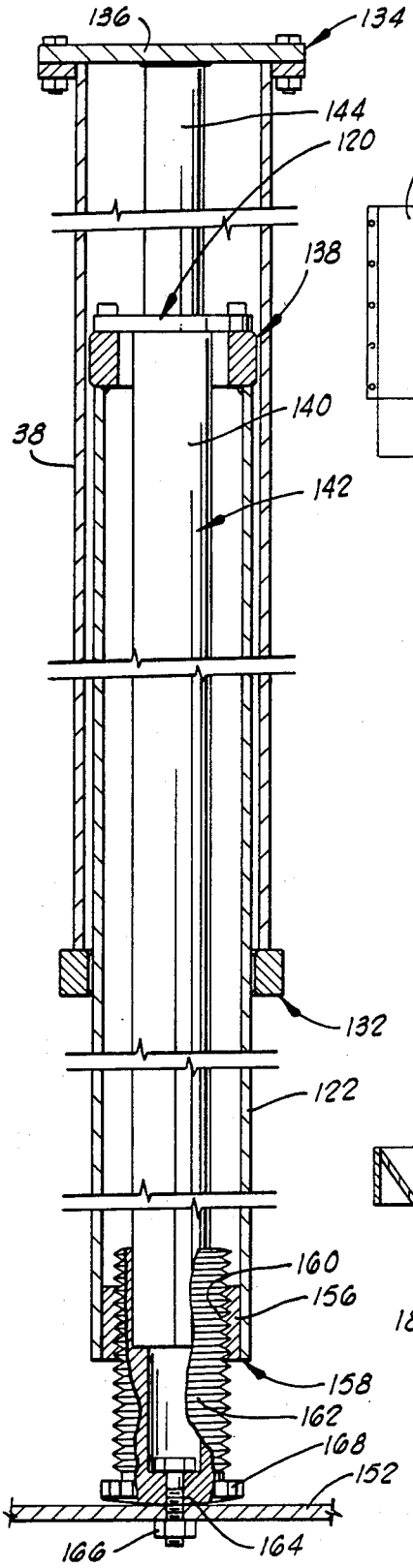
FIG. 6 is an elevational cross section of a frame elevating assembly for the silo main frame and conveyor support.

In order to raise and lower the silo main frame 24, the silo is further provided with a plurality of frame elevation assemblies 120 that are mounted within the posts 38–48 as shown in FIG. 6 to which attention is now invited. As shown in FIG. 6, the lower end 132 of each post is open and the upper end 134 is closed by a cap 136 that conveniently can be bolted to the post 38. (For clarity of illustration, the post shown in FIG. 6 has been designated by the numeral 38. However, the post in FIG. 8 can be any one of the post 38–48 of the silo main frame and, additionally, can be a post of a conveyor support to be discussed below.) Each frame elevation assembly 120 is comprised of a leg 122 having an open upper end 138 to which is bolted the barrel 140 of a hydraulic actuating cylinder 142, the barrel 140 extending downwardly into the leg 122 and the piston rod 144 of the hydraulic actuating cylinder 142 extending upwardly of the leg 120 to engage the cap 136 on the pose 38. (For clarity of illustration, hydraulic conduits to the barrel 140 have not been shown in the drawings. These can be conveniently introduced into upper portions of the post 38 and coiled about the piston rod 144.) It will thus be seen that the silo frame 24 can be raised or lowered by extending or retract the legs 122 from the post 38–48 using any convenient of pressurized hydraulic fluid to operate the hydraulic actuactor cylinders 142. The walls of the legs and posts can also be with suitable holes (not shown) to maintain the legs extended and retracted positions without maintaining transmit of pressurized hydraulic fluid to the hydraulic actuating inders in the legs.

Retuning FIG. 5, the preferred embodiment of the silo 20 includes 146, 148 and 150 that are adjustably attached to lateral pairs of legs 122 of the frame support assemblies 120 to the silo in the erected position and to provide for of the silo in such position. In general, each of the footpads 146–150 is comprised of a plate 152 upon which a box member 154 has been welded to provide the footpads with a rigidity that will enable the footpads to provide a solid foundation for the silo 20 that eliminates any need for extensive preparation of a worksite prior to emplacement of the silo 20. Rather, the worksite need be only roughly leveled and adjustments to the connection between the footpads 146 through 150 and legs 122 are then used to provide a stable support to the silo 20.

To provide for an adjustable connection between the footpads 146–150 and the legs 122, the frame elevation assemblies are provided with additional structure that is illustrated in FIG. 6. As shown therein, a tubular member 156 is welded into the lower end 158 of the each 122, the member 156 having a threaded bore 160 that matingly receives a hollow screw 162. The lower end of each screw is then attached to one end of one of the plates 152 by a bolt 164 that extends axially from the screw 162 to pass through a hole in the plate 152 and be secured thereto by nut 166. Such attachment enables the screw 162 to be turned in the tubular member 156, so that the screw can be extended or withdrawn from the leg 122, and turning of the screw 162 is facilitating by forming a milled flange 168 on the lower end of the screw 162 to be engaged by a suitable spanner wrench. Consistently with the ease of emplacement aspect of the invention, a hydraulic pump (not shown) can be mounted on the footpad 148 and the box structure 154 of the footpad 148 can be formed into a sump to provide a source of pressurized hydraulic fluid for operation of the hydraulic actuating cylinders in the legs 122 of the frame elevation assemblies 120 and additional hydraulic actuating cylinders to be noted below.

As will be discussed below, the conveyor 32 is pivotally mounted on the silo main frame 24 so that the conveyor 32 can be positioned to extend through upper portions of the frame 24 in the transport position of the silo 20. Additionally, the bins 28 and 30 are constructed to receive portions of the conveyor 32 in the transport position of the silo without reduction of the capacity of the bins 28, 30 after the silo has been erected. Such construction has been illustrated in FIGS. 1, 2, 3, 4, 7 and 8 for the first bin 28 and in FIGS. 1, 2A and 2B, 3, 4, and 11 for the second bin 30.

Figure 7:
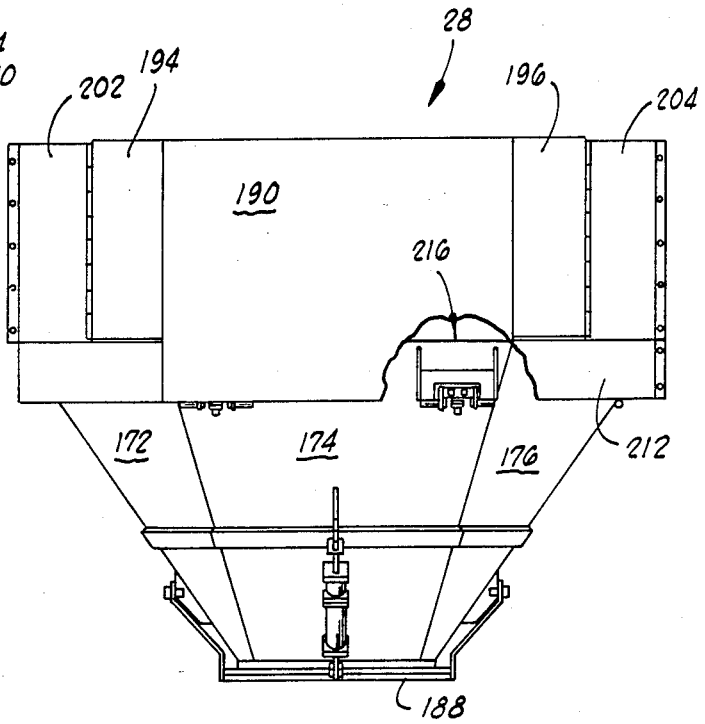
FIG. 7 is a side elevational view in partial cutaway of the first bin of the silo of FIG. 1.
Figure 8:
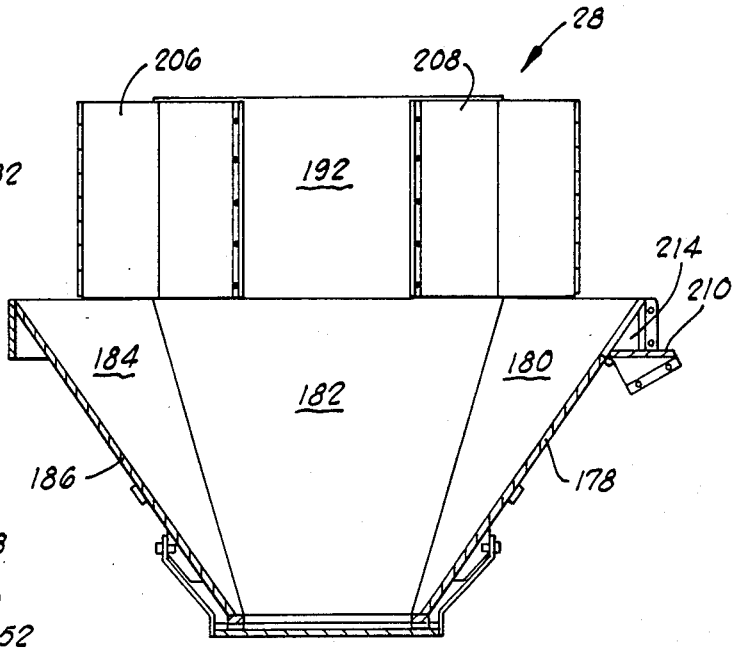
FIG. 8 is a side elevational cross section of the first bin of the silo.

As shown in FIGS. 3, 7, and 8, the first bin 28 is comprised of a lower portion formed by eight generally triangular plates 172–186 that have been welded together to form a generally conical structure that converges toward the bottom of the silo main frame 24 when the bin 28 is mounted thereon in a manner to be discussed below. A conventional pneumatically operated clamshell gate 188 is mounted at the lower end of the bin 28 to permit asphaltic concrete to be dispensed from the bin 28 in a conventional manner.

Figure 4:
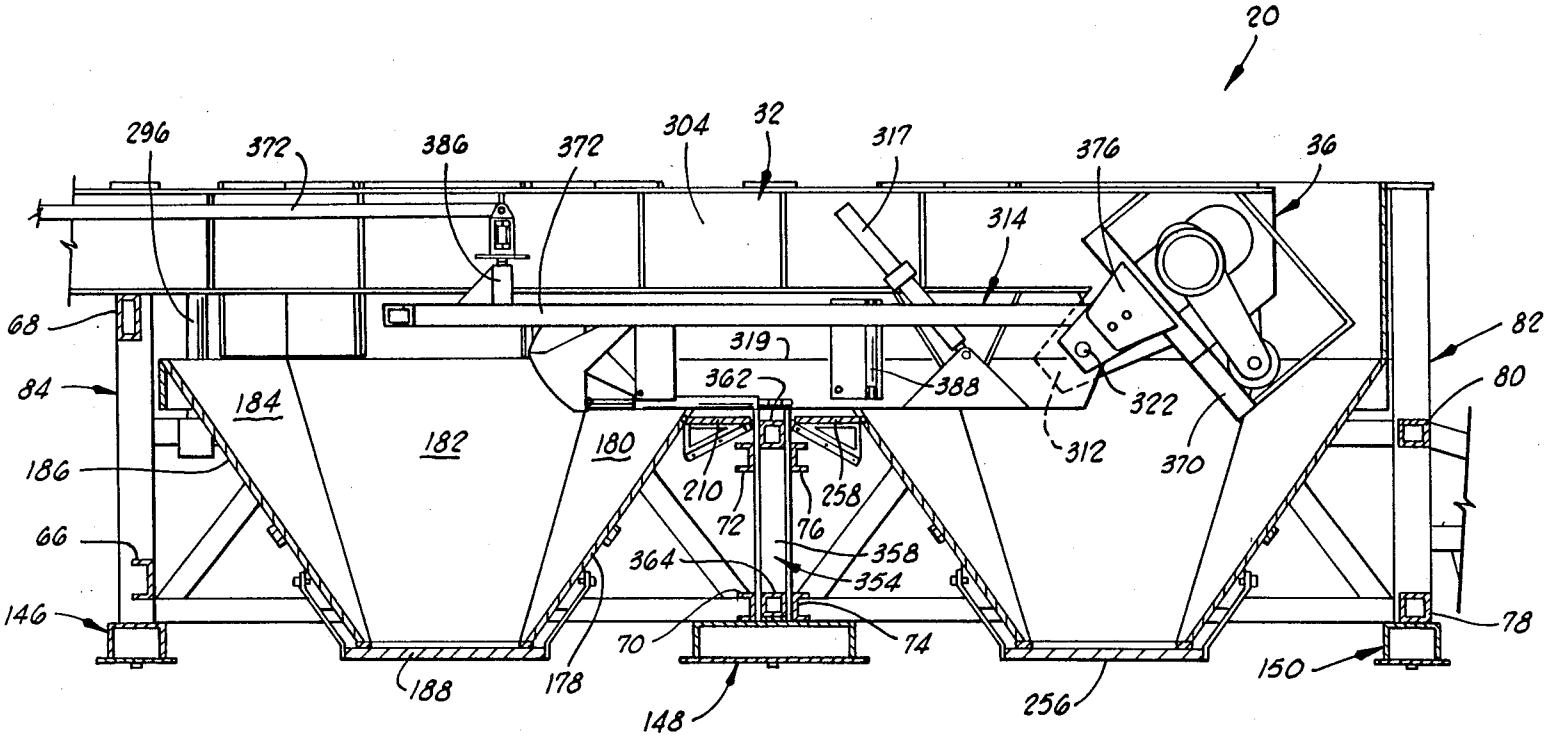
FIG. 4 is a fragmentary cross section taken along the center line of FIG. 3.
Figure 5:
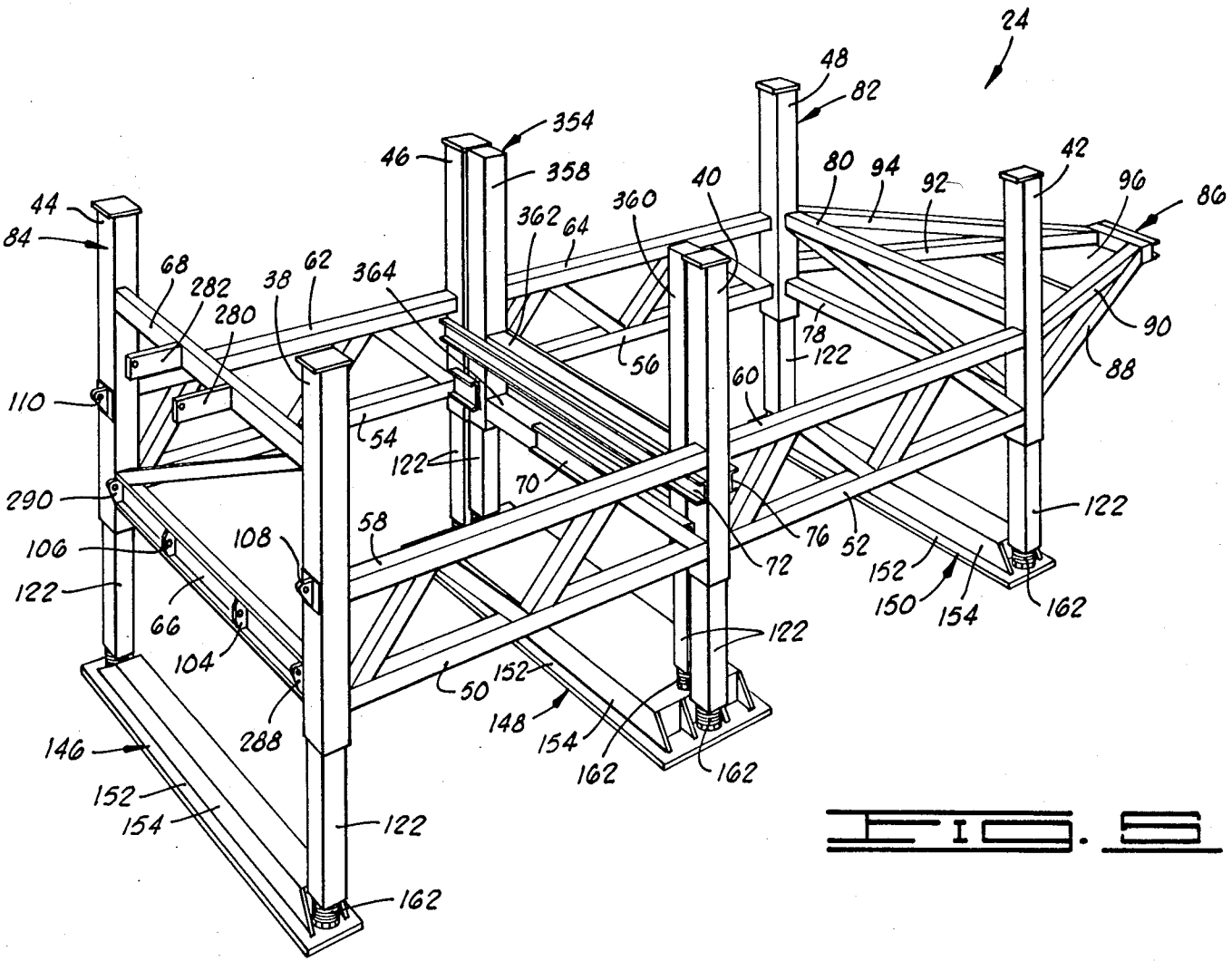

In addition to the lower portion formed by the plates 172–186, the first bin 28 is comprised of two side portions 190 and 192 that extend upwardly from the plates 174 and 182 of the lower conical portion of the bin 28 so that the side portions will extend laterally along opposite sides of the conveyor 32 when the bin 28 is mounted on the frame 24 and the conveyor 32 is placed in the transport position thereof as shown in FIGS. 3 and 4. In order to provide maximum capacity for the bin 28 in the erected silo 20 consistent with the positioning of portions of the conveyor within the bin 28 during transport, the bin 28 is further comprised with a plurality of closures that extend between the side portions 190 and 192 to extend the asphaltic concrete capacity of the bin 28 to the top of the side portions 190, 192. In particular, the bin 28 is provided with canted plates 194, 196 that are welded to the ends of the portion 190 in vertical alignment with portions of the plates 172 and 176 respectively that are adjacent to the plate 174 and canted plates 198, 200 (FIG. 3) that are similarly aligned with respect to the side portion 192 and plates 184 and 180 respectively. Doors 202, 204, 206 and 208, are hingedly connected to the distal ends of the plates 194, 196, 198 and 200 respectively so that the doors 202–208 can be swung into the bin 28, as shown in FIG. 3 and as shown for the doors 206 and 208 in FIG. 8, thereby forming clearance for passage of portions of the conveyor 32 through the bin 28 between portions 190 and 192 of the bin 28. Alternatively, the doors 202–208 can be swung outwardly, as shown for the doors 202 and 204 in FIG. 7, to extend vertically upwardly from portions of the plates 186 and 178 and portions of the plates 172, 184 adjacent plate 186 and portions of plates 176 and 180 adjacent plate 178, the doors 202–208 each being provided with a central, vertical bend to conform to the generally conical configuration of the lower portion of the bin 28. Securing of the distal edge of the door 202 to the distal edge of the door 206 and securing of the distal edge of the door 204 to the distal edge of the door 208 in these latter positions can be effected in any convenient manner; for example, by providing the doors with apertured flanges along their distal edges, as shown in the drawings, for bolting the distal edge of each door to the mating distal edge of another door. Additionally, a pivoting door 210 is formed on upper portions of the plate 178 as shown in FIG. 8 for a purpose that will become clear below. The door 210 can be secured in a closed position in which the door 210 extends the plate 178 to the doors 204 and 208 by apertured flanges at the lateral edges of the door 210 and mating apertured flanges mounted on skirt plates 212, 214 that extend along upper portions of the plates 176 and 180 respectively.

Figure 9:
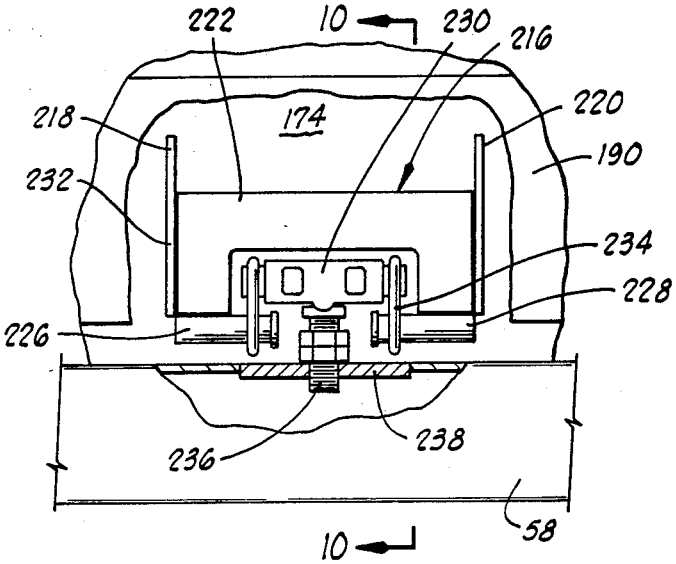
FIG. 9 is an enlarged fragmentary side elevational view in partial cutaway of the first bin illustrating the construction of a load cell used in the mounting of the bins on the silo main frame.
Figure 10:
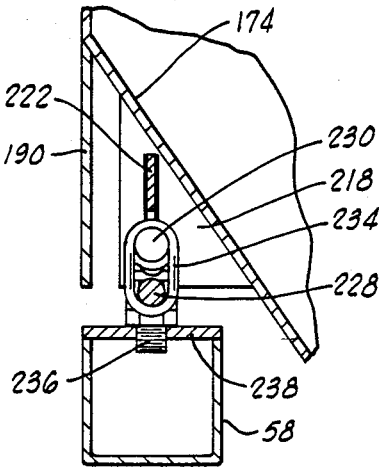
FIG. 10 is a cross section of the load cell of FIG. 9 taken along line 10—10 of FIG. 9.

The mounting of the first bin 28 on the silo main frame 24 has been shown for one side of the bin 28 in FIGS. 7, 9 and 10. As shown in these Figures, a load cell 216 is mounted on the plate 174 adjacent the juncture between the plate 174, the plate 176, and the portion 190 of the bin 28 and an identical load cell is mounted on the plate 174 at the juncture of such plate with the plate 172 and the portion 190. Each of these load cells is comprised of two spaced apart triangular plates 218 and 220 (FIGS. 9 and 10) welded to the plate 174 and a cross member 222 is welded between the plates 218, 220 to provide a mount, via welding, for two pins 226, 228 that extend toward each other from the plates 218 and 220. The pins 218 and 220 provide points of support for portions of the bin 28 at one lower corner of the portion 190 with such support being effected by a bar-shaped transducer 230 that is supported by the bolster 58 and, in turn, supports the pins 226 and 228 via links 232 and 234 that loop about the ends of the pins and the ends of the transducer as shown in FIGS. 9 and 10. The transducer 230 is conveniently supported on the bolster 58 via a bolt 236 that screws into a plate 238 welded into the upper side of the bolster 58 and having a concave upper end to receive a projection from the center of the transducer 230. Identical load cells support the first bin 28 at the opposite lower corner of the portion 190 and at both lower corners of the portion 192 to provide four point support of the first bin 28 on the silo main frame 24 and, via the transducers of the load cells, to provide a measure of the quantity of hot mix asphaltic concrete in the first bin 28.

Figure 11:
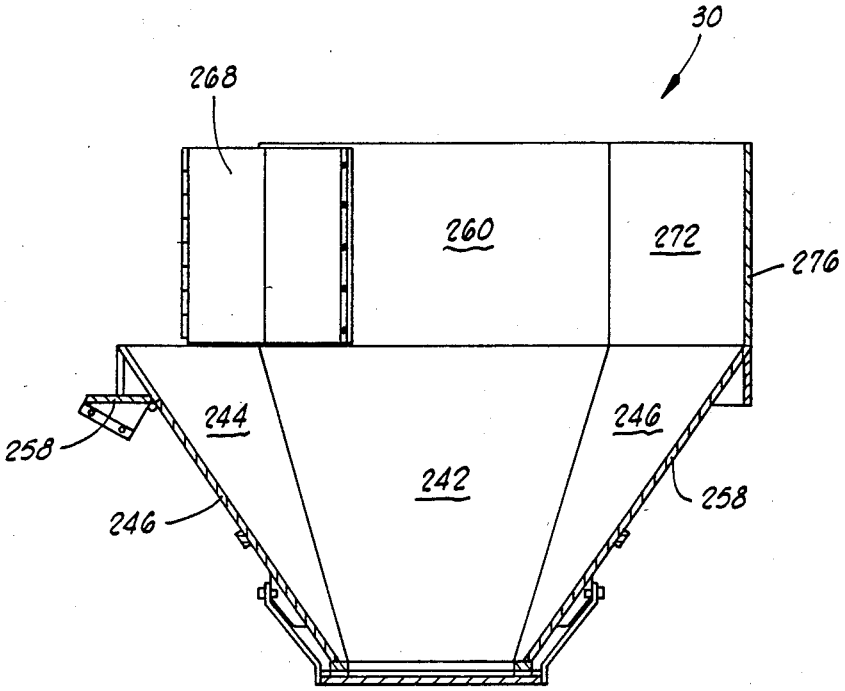
FIG. 11 is a side elevational cross section similar to FIG. 8 of the second of the silo shown in FIG. 1.

The second bin 30 is similar in construction to the first bin 28 and is supported on the silo main frame via load cells in a manner that is identical to the support of the first bin 28 so that it will not be necessary for purposes of this disclosure to describe the second bin 30 in complete detail. Rather, it will suffice to indicate structures of the bin 30 that correspond to structures of the bin 28 and point out the few structural differences that exist between the two bins. Thus, the second bin 30 is comprised of plates 240–254 that are constructed identically to the plates 172–186 and positioned with respect to each other in a manner that is identical to the relative positions of the plates 172–186 so that the plates 240–254 form a conical lower portion for the bin 30 that is identical to the lower portion of the bin 28 and is closed at its lower end by a pneumatically operated clamshell gate 256 in the same manner that the lower end of the bin 28 is closed. Similarly, just as the plate 178 is provided with the door 210, the corresponding plate 246 is provided with a door 258 that can be opened downwardly as illustrated in FIGS. 4 and 11. Indeed, the only difference between the lower portions of the bins 28 and 30 is one of orientation in the silo main frame 24. As will be clear from FIGS. 3 and 4, the bin 30 is rotated a half turn so that the gates 210 and 258 will be adjacent for a purpose that will become clear below.

Above the conical lower portion of the bin 30, the bin 30 is comprised of side portions 260, 262 that are identical to the side portions 190, 192 respectively and identically placed in the bin 30 as the portions 190, 192 are placed in the bin 28. Similarly, canted plates 264 and 266 are attached to one edge of each of the side portions 260, 262 respectively to extend upwardly from portions of the plates 244 and 248 in the same manner that the plates 196 and 200 are attached to the portions 190 and 192 of the bin 28 to extend upwardly of the plates 176 and 180, the plates 264 and 26 hingedly supporting doors 268 and 270 that correspond to the doors 204 and 208 of the first bin 28. The only difference between upper portions of the two bins lies in the manner in which closure of the end of the bins adjacent the ends of the silo main frame 24 is effected. In place of the doors 202 and 206 of the first bin and the canted plates 194 and 198 to which such doors are pivotally attached in the first bin 28, the second bin 30 is provided with canted plates 272 and 274 that extend the entire width of plates 240 and 252 respectively and are joined by a closure bulkhead 276 that is welded between the plates 272 and 274 and extends vertically from the plate 258 across the entire width of the plate 258. As noted above, the mounting of the second bin 30 on the silo main frame 24 is effected via load cells in the manner that such mounting is effected for the first bin 28, such load cells being positioned at the two lower corners of the side portions 260 and 262 of the second bin 30 in the same manner that supporting load cells are positioned for the first bin 28.

Coming now to the conveyor 32, reference is made initially to FIG. 5 which most clearly illustrates fittings on the silo main frame 24 used to pivotally mount the conveyor 32 thereon. In particular, such fittings include a pair of spaced apart, apertured plates 280, 282 that are welded to central portions of the cross member 68 to extend from the rear end 84 of the silo main frame 24. The plates 280, 282 are separated by a distance substantially equal to the width of the conveyor 32 so that apertured, depending connectors 284, 286 (FIGS. 1, 2A, 2B and 3) welded to the sides of the conveyor 32 can be placed about the plates 280 and 282 for pinning of the conveyor 32 to the silo main frame 24. As indicated in FIG. 5, the plates are laterally positioned to centrally position the conveyor 32 on the silo main frame 24 and the cross member 68 is vertically positioned on the silo main frame 24 such that the conveyor 32 can be pivoted to extend along upper portions of the silo main frame 24 as shown in FIGS. 2A and 2B. To insure that the connection between the silo main frame 32 and the conveyor 32 is of sufficient strength to support the conveyor, additional apertured plates 288 and 290 are welded to the cross member 66 to provide for connection of braces, one of which is illustrated in the drawings and designated 292 therein between the cross member 66 and the plates 280, 282. Pivotation of the conveyor 32 on the silo main frame is effected by hydraulic actuating cylinders 294 and 296 connected between the bolsters 58 and 62 of the silo main frame 24 and lateral projections 298 and 300 mounted on the sides of the conveyor 32.

Figure 12:
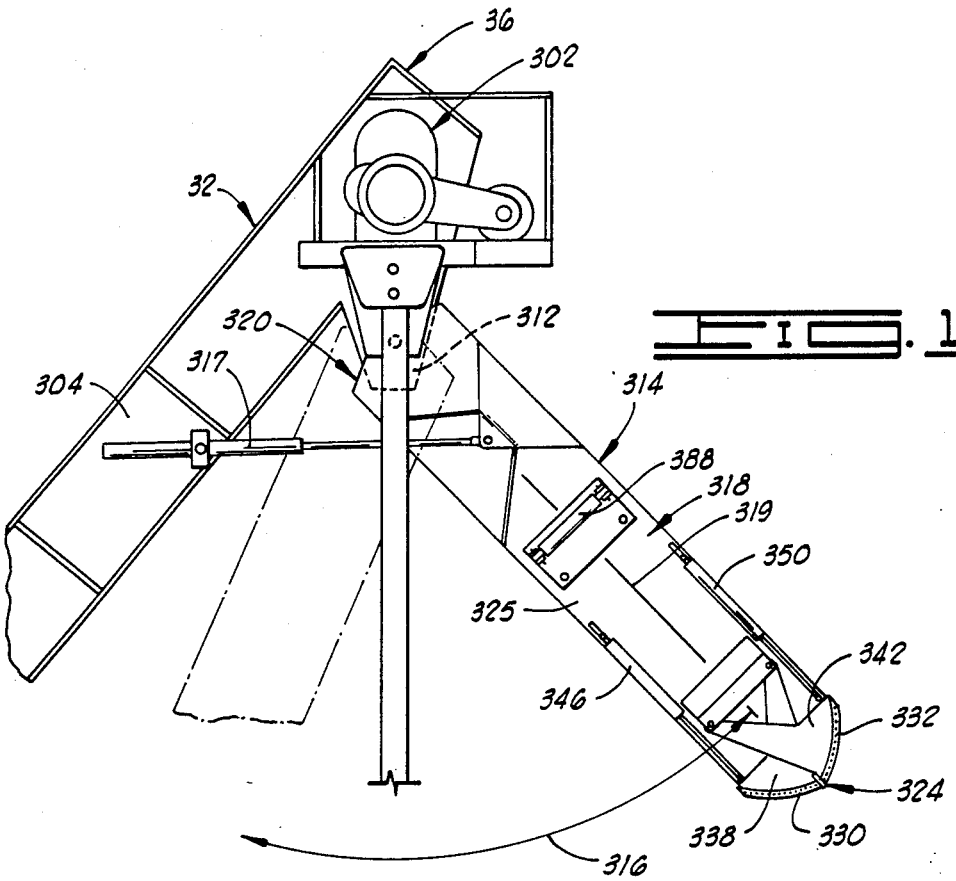
FIG. 12 is a fragmentary side elevational view of the conveyor of the silo of FIG. 1 showing the mounting of the slug feeder on the conveyor.

The construction of the conveyor 32 is largely conventional so that a detailed description of the structure of the conveyor 32 will not be necessary for purposes of disclosure of the silo 20. Rather, it will suffice to note that the conveyor 32 is preferably a drag chain conveyor having a conventional drive 302 at the upper end 36 to continuously move a plurality of slats (not shown) in an endless loop within a tubular housing 304 and point out characteristics of the conveyor 32 associated with the invention. One such characteristic is the presence of an opening 306 in portions of the conveyor housing 304 on the underside of the conveyor adjacent the pivotal connection of the conveyor 32 to the silo main frame 24 and an asphalt dispensation door 308 that is pivotally attached to the underside of the conveyor 32 to alternatively open and close the opening 306. A suitable mechanism for effecting the opening and closing of the door 308 is comprised of a pair of pneumatic cylinders, one of which has been illustrated in FIGS. 2A and 2B and designated 310 therein, mounted on opposite sides of the conveyor and connected to opposite sides of the door 308. As indicated in FIG. 12, portions of the housing 304 near the upper end 36 of the conveyor 32 are formed into a downwardly directed discharge chute 312 to discharge asphaltic concrete at a height above the bins 28 and 30. An important aspect of the invention is the manner in which this asphaltic concrete is subsequently delivered to a selected one of the bins 28 and 30. To this end, the silo 20 is further comprised of a slug feeder 314 that is pivotally attached to the upper end 36 of the conveyor 32 for pivoting movement of a longitudinal centerline 319 of the slug feeder in a vertical arc 316 below the conveyor 32. Pivotation of the slug feeder 314 can conveniently be effected by a pair of hydraulic cylinders, one of which has been illustrated in the drawings and designated by the numeral 317 therein, mounted on opposite sides of the conveyor and connected to the slug feeder 314.

Figure 13:
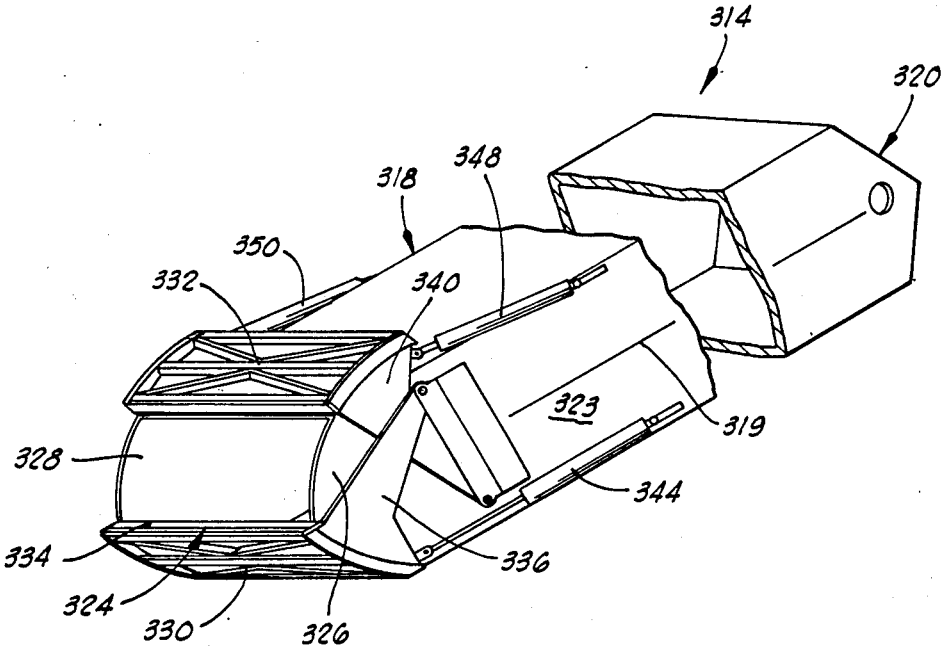
FIG. 13 is an isometric view of the slug feeder.

Referring to FIG. 13 and with continuing reference to FIG. 12, the slug feeder 314 is comprised of a rectangular tube 318 having an open upper end 320 that fits over the discharge chute 312 when the slug feeder 314 is mounted on the conveyor 32. For this purpose, portions of the side walls 323, 325 of the tube 318, adjacent the upper end of the slug feeder 314, are provided with apertured extensions that are pinned on the centerline 319, as at 322 in FIG. 4, to the sides of the discharge chute 312. The lower end 324 of the tube 318 is similarly open and the side walls 323, 325 are provided with arcuate portions 326, 328 on which two clamshell gates 330 and 332 are slidably mounted for closing such end 324 of the slug feeder 314, the clamshell gates coming together at a seal strip 334 at the centerline of the slug feeder. Mounting of the clamshell gates 330, 332 is effected by plate members 336, 338, for the clamshell gate 330, and plate members 340, 342, for the gate 332, that are pivotally attached to the sides 323, 325 of the tube 318. The gate 330 is opened and closed by pneumatic cylinders 344 and 346 on opposite sides of the tube 318 and similar pneumatic cylinders 348, 350 are provided to open and close the gate 332. The clamshell gates 330, 332 are mounted on opposite sides of the centerline 319 so that one clamshell gate will be positioned at the bottom of the slug feeder 314 in the position shown in solid lines in FIG. 12, in which position the lower end of the slug feeder will be above the second bin 30, while the other clamshell gate will be positioned at the bottom of the slug feeder in the position indicated in dot-dash line in FIG. 12 in which position the lower end of the slug feeder will be positioned above the first bin 28. Thus, the clamshell gates provide unrestricted outflow to either of the bins 28, 30 enabling the slug feeder 314 to collect a quantity of hot mix asphaltic concrete from the conveyor 32 and release such quantity as a slug of material to either bin 28 or 30.

In the erected position of the silo 20 shown in FIG. 1, the upper end of the conveyor is supported by a conveyor support generally designated 352 in such Figures and comprised of a lower support frame 354 (FIG. 5) and an upper support frame 356. As shown in FIG. 5, the lower support frame 354 is comprised of a pair of vertical posts 358 and 360, that are positioned between the posts 40 and 46 of the silo main frame 24, and laterally extending tubes 362 and 364 (See also FIG. 4) that are welded to and extend between the posts 358 and 360. (For clarity of illustration, bracing for the posts 358 and 360 and tubes 362 and 364 have not been shown in the drawings.) With such positioning of the posts 358, 360, the lower support frame 354 is captured between the lateral members 70–74 of the silo main frame 24 so that the lower support frame 354 extends vertically through the center of the silo main frame 24 between the bins 28 and 30. Like the silo main frame, the lower support frame is vertically positionable so that the upper ends of the posts 358 and 360 can be maintained level with the upper ends of the posts 40 and 46 in both the raised and lowered positions of the silo main frame 24. To this end, the posts 358 and 360 are constructed in the manner that has been discussed above for the posts 38–48 and each of the posts 358 and 360 is provided with a frame elevation assembly 120 that is constructed in the manner that has been discussed above with reference to FIG. 6 and rests on the center footpad 148 so that extension of the legs 122 of the assemblies 120 in the posts 358 and 360, coupled with rotation of the screws 162 of these assemblies 120, permits the lower support frame 354 to be positioned in vertical alignment with the silo main frame in both the erected and transport positions of the silo 20.

A platform 370 is mounted on the upper end 36 of the conveyor 32 to support the conveyor drive 302 and the upper support frame 356 can be conveniently mounted on the platform 302 in a manner that has been shown in FIGS. 3 and 4. As shown therein, the upper support frame 356 is comprised of two legs 372, 374 that are pinned on opposite sides of the conveyor housing 304 to plates 376, 378 welded to opposite sides of the platform 370. A cross member 380, having a length equal to the spacing of the posts 358, 360 of the lower support frame 354, is welded between the distal ends of the legs 372, 374 so that the upper support frame 352 can be pivoted on the conveyor 32, at such times that the silo 20 is in the erected position, to rest the cross member 380 on the upper ends of the posts of the lower support frame 354 as shown in FIG. 1. Alternatively, the upper support frame 356 can be pivoted on the plates 376, 378 to extend along the underside of the conveyor 32, in the transport position of the silo 20, as shown in FIGS. 3 and 4. Maintenance of the upper support frame 356 in the extended position shown in FIG. 1 is effected by additional pinning of the legs 372, 374 to the plates 376, 378 and by braces 382, 384 that are pivotally attached to tubes 386 welded perpendicularly to the legs 372, and 374 as shown for the leg 372 in FIG. 4, and pivotally and slidably attached to the projections 298 and 300. Lock screws (not shown) are provided to fix the braces once the upper support frame 356 is in position. Maintenance of the upper support frame 356 in the transport position shown in FIGS. 3 and 4 is effected by struts 88 and 390 that are mounted on the sides of the slug feeder 314 and can be bolted to 372 and 374 respectively.

OPERATION OF THE PREFERRED EMBODIMENT

When the silo 20 is emplaced at a work site for storage and dispensation of hot mix asphaltic concrete, it will be in the erected position shown in FIG. 1 to permit the introduction o asphaltic concrete produced by an on-site mixing apparatus into the lower end 34 of the conveyor 32. It is contemplated that the road construction project for which the silo 20 has been set up will, at times, require differing grades of asphaltic concrete and the silo 20 is used at such times to provide a multi-grade asphaltic concrete storage and dispensation capability to contractors in the field. To this end, the first bin 28 will be selected for the dispensation of one grade of asphaltic concrete while the second bin 30 will be selected for the dispensation of a second grade. In accordance with this selection, the asphaltic concrete mixing apparatus (not shown) with which the silo 20 is used, will be operated to produce the different grades on an as-needed basis and asphaltic concrete of both grades will be introduced into the lower end 34 of the conveyor 32 for transport to the upper end 36 thereof. The slug feeder is then pivoted along the arc 316 (FIG. 12) so that the lower end 324 thereof will be located above the bin 28, 30 that is to receive the grade of asphaltic concrete being produced. In this position, both clamshell gates 330, 332 of the slug feeder 314 will be held closed by the pneumatic cylinders 344—350 to permit collection of a quantity of asphaltic concrete within the slug feeder 314. Periodically, the clamshell gates 330, 332 are opened to drop the asphaltic concrete that has collected in the slug feeder 314, as a discrete slug, into the selected bin 28, 30. As noted above, the construction and placement of the gates 330, 332 will insure that all portions of the lower end of the slug feeder 314 will be uncovered when the gates 330, 332 are opened so that the entire contents of the slug feeder 314 will be released when the gates 330, 332 are opened.

Concurrently with the storage of asphaltic concrete in the bins 28, 30, the bins 28 and 30 can be operated to dispense weighed quantities of asphaltic concrete to trucks for movement to a road construction site. To this end, the elevation of the silo main frame 24 on the legs 122 forms two dispensation bays, one under each bin 28, 30, into which a truck can be driven so that asphaltic concrete can be dispensed into the truck by opening the clamshell gate at the lower end of the bin above the bay. For measurement of the quantity of asphaltic concrete dispensed, the gates of the slug feeder 314 can be held closed during dispension of the asphaltic concrete to a truck so that the difference in weight of the dispensing bin and its contents, indicated by the load cells 216 supporting such bin, provides a measure of the weight of the dispensed asphaltic concrete. Alternatively, asphaltic concrete issuing from the conveyor 32 can be deposited in one bin while the other bin is utilized to dispense asphaltic concrete to a truck.

At times, an odd lot of asphaltic concrete will be needed by a consumer and, in such cases, either grade of asphaltic concrete stored in the silo will often suffice for the consumer's purposes. In these cases, the odd lots can be provided without interruption of normal operations in which the asphaltic concrete is delivered to trucks for road construction use. To this end, the positioning of the asphalt dispensation door 308 adjacent the pivoting connection between the conveyor 32 and the silo main frame 24 forms, in effect, a third asphaltic concrete dispensation bay into which a truck can be driven to receive asphaltic concrete directly from the conveyor 32 by opening the door 308 to permit asphaltic concrete to exit the conveyor 32 via the opening 306.

Once a road construction project for which the silo has been set up has been completed or has progressed to a location for which the silo 20 and accompanying asphaltic concrete mixing apparatus is inconveniently located, the construction of the silo 20 permits rapid transport to a new, more convenient site. To this end, the silo 20 is placed in the transport mode illustrated in FIGS. 2A and 2B through 4 in the following steps. Initially, connections between the doors 202–208 of the first bin 28 and the doors 268 and 270 of the second bin 30 are removed and the doors 202–208 and 268, 270 are pivoted into the bins 28 and 30 to the positions shown in FIG. 3. Additionally, connections between the ends of the doors 216 and 258 are broken so that these doors can be swung downwardly to the positions shown in FIG. 4. Thus, clearance is provided for movement of portions of the conveyor 32 adjacent the upper end thereof, the slug feeder 314, and the upper support frame 356 of the conveyor support 352 into upper portions of the bins 28, 30. To this end, the braces 382 and 384 are freed for pivotation on the tubes 386 and movement on the projections 298 and 300 after which the slug feeder 314 is connected to the upper support frame 356 via the struts 388 and 390 and is then drawn into engagement with the under side of the conveyor 32, as shown in FIG. 3, by the hydraulic cylinders 317. (Ladders which, for clarity of disclosure, have not been shown in the drawings are mounted on the silo main frame 24 and on the upper support frame 356 provide ready access to all portions of the silo 20 to facilitate these operations.) The hydraulic actuating cylinders 294 are then operated to swing the conveyor 32, the slug feeder 314 and the upper support frame 356 into the bins 28, 30 as shown in FIGS. 3 and 4.

Following the stowing of the slug feeder 314, the upper support frame 356 and portions of the conveyor 32 in the bins 28 and 30, the hydraulic actuating cylinders 120 of the frame elevation assemblies located in the posts 38–48 of the silo main frame 24 and in the posts 358 and 360 of the lower support frame 354 are operated to lower the silo main frame 24 to the lowered position shown in FIGS. 2A and 2B and to concurrently lower the lower support frame 354 to maintain a level relation between the frames 24 and 354. The dolly 22 is then attached to the rear end 84 of the silo main frame 24 and a truck (not shown) equipped with a fifth wheel is mated with the fifth wheel connector 86 at the forward end 82 of the silo main frame. Transition of the silo 20 to the transport position is then completed by retracting the foot pads 146–150 by turning the screws 162 of the frame elevation assemblies 120 in the posts 38–48 of the silo main frame 24, turning the screws 162 of the frame elevation assemblies in the posts 358 and 360 of the lower support frame 354 of the conveyor support 352 to maintain a level relation between the frames 24 and 354, and attaching braces, such as the brace 392 shown in FIGS. 2A and 2B, between the conveyor 32 and the dolly 22. With the silo 20 in the transport mode, the silo 20 can then be moved to a new site and quickly returned to the erected position by reversing the steps described above. Specifically, return to the erected position is effected by lowering the foot pads 146–150, raising the silo main frame 24 and lower support frame 354, pivoting the conveyor 32 to the operating position thereof, pivoting the upper support frame 356 to the position shown in FIG. 1 and bracing the frame 356 in such position, and closing the doors 202–208, 268, 270, 210, and 258 of the bins 28, 30.

It will be clear that the present invention is well adapted to carry out the objects and attain the ends and advantages mentioned as well as those inherent therein. While a presently preferred embodiment has been described for purposes of this disclosure, numerous changes may be made which will readily suggest themselves to those skilled in the art and which are encompassed in the spirit of the invention disclosed and as defined in the appended claims.

What is claimed is:

1. A silo for storing and dispensing hot mix asphaltic concrete, comprising:

a silo main frame disposed at a selected height above the earth's surface;

a plurality of bins supported on the silo main frame for storing and dispensing the hot mix asphaltic concrete;

a conveyor extending in an operating position thereof along an angle from a lower end thereof at the earth's surface to an upper end thereof above the bins for receiving hot mix asphaltic concrete at the lower end thereof and discharging the hot mix asphaltic concrete at the upper end thereof; and slug feeder means, mounted on the upper end of the conveyor to receive the hot mix asphaltic concrete discharged from the conveyor, for forming slugs of hot mix asphaltic concrete and discharging the slugs into selected bins at selected times.

2. The silo of claim 1 wherein an opening is formed in the underside of the conveyor adjacent the silo main frame and wherein the silo further comprises:

an asphalt dispensation door pivotally connected to the underside of the silo for swinging movement between a closed position overlaying the opening in the underside of the conveyor and an open position extending away from the underside of the conveyor; and means for selectively moving the asphalt dispensation door between the open and closed positions thereof.

3. The silo of claim 1 further comprising a plurality of load cells mounted on the silo main frame and connected to the bins to support the bins on the main frame, whereby the load cells provide an indication of the quantity of hot mix asphaltic concrete in each of the bins.

4. The silo of claim 1 wherein the slug feeder means a tube pivotally mounted on the upper end of the conveyor for movement of the longitudinal centerline of the tube in a vertical arc above the bins, the tube having an open upper end for receiving the hot mix asphaltic concrete from the conveyor and an open lower end for depositing the hot mix asphaltic concrete into the bins;

means for pivoting the tube on the discharge end of the conveyor so as to position the lower end of the tube above a selected one of the bins;

a first gate pivotally mounted on the lower end of the tube for movement about an axis perpendicular to the arc of movement of the tube between a closed position wherein the first gate overlays portions of the lower end of the tube to one side of the longitudinal centerline of the tube and an open position wherein the first gate is displaced laterally from the lower end of the tube;

a second gate pivotally mounted on the lower end of the tube for movement about an axis perpendicular to the arc of movement of the tube between a closed position wherein the second gate overlays portions of the lower end of the tube to the opposite side of the longitudinal centerline of the tube and an open position wherein the second gate is displaced laterally from the lower end of the tube; and means for selectively moving the gates between open and closed positions thereof.

5. A silo as defined in claim 1 characterized further a detachable wheeled dolly;

means for connecting the wheeled dolly to one end of the silo in the lowered position of the silo main frame; and a fifth wheel connector mounted on the opposite end of the silo main frame for connecting the main frame to a fifth wheel of a transporting vehicle whereby the silo can be placed in an erected position for dispensing hot mix asphalt by detaching the dolly, raising the silo main frame and positioning the conveyor in the operating position and placed in a transport position for towing by a tractor having a fifth wheel by lowering the silo main frame, moving the conveyor to the transport position thereof and attaching the dolly to the silo main frame.

6. The silo of claim 1 wherein the conveyor is pivotally mounted on the silo main frame for movement between said operating position and a transport position wherein the conveyor extends longitudinally along upper portions of the silo main frame and wherein the silo further comprises:

conveyor pivotation means connected between the conveyor and the silo main frame for pivoting the conveyor between the transport and operating positions thereof; and silo main frame elevation means, mounted on the silo main frame, for alternatively elevating the silo main frame to a raised position wherein the silo main frame is disposed at said selected height above the earth's surface such that trucks can be positioned beneath the bins for receiving the hot mix asphaltic concrete, and lowering the silo main frame to a lowered position thereof adjacent the earth's surface.

7. The silo of claim 6 further comprising means for supporting the upper end of the conveyor in the erected position of the silo.

8. The silo of claim 6 wherein each bin is characterized as comprising:

two side portions positioned to extend laterally along opposite sides of the conveyor at such times that the conveyor is in the transport position thereof; and means for forming closures between the side portions at each end of the bin at such times that the conveyor is in the operating position thereof.

9. The silo of claim 6 wherein the silo main frame is characterized as comprising a plurality of vertical, tubular posts and wherein the silo main frame elevation means comprises:

a plurality of legs telescopingly mounted in the tubular posts of the silo main frame for movement into and out of the lower ends of said posts; and means for selectively extending the legs from the posts and retracting the legs into the posts.

10. The silo of claim 9 further comprising:

a plurality of footpads underlaying the telescoping legs; and means for adjustably connecting the footpads to the lower ends of the legs for vertical movement of the footpads on the legs, whereby the footpads can be lowered to the earth's surface to support the silo in the erected position thereof and raised from the earth's surface for transport of the silo in the transport position thereof.

11. The silo of claim 10 wherein the means for adjustably connecting the footpads to the lower ends of the legs comprises:

a vertical, internally threaded tubular member within the lower end of each leg; and a plurality of vertical screws rotatably mounted on the footpads to extend into and mate with the tubular members within said legs.

12. The silo of claim 10 further comprising conveyor support means for supporting the upper end of the conveyor in the erected position of the silo, the means for supporting the upper end of the conveyor comprising:

a conveyor lower support frame comprising a pair of laterally spaced, tubular vertical posts positioned between a pair of vertical posts of the silo main frame;

a leg telescopingly mounted in the tubular post of each post of the conveyor lower support frame for movement into and out of the lower end of said conveyor support frame post, whereby the conveyor lower support frame can be placed in a raised position at such times that the silo main frame is placed in the raised position thereof and in a lowered position for transport of the silo;

a vertical, internally threaded tubular member within the lower end of each leg of the conveyor support means;

a pair of vertical screws rotatably mounted on one of the footpads to extend into and mate with the tubular members within the legs of the conveyor support means; and a conveyor upper support frame pivotally attached to the conveyor for pivoting movement between a transport position extending along the underside of the conveyor in the transport position of the silo and a support position wherein the conveyor upper support frame rests on the conveyor lower support frame in the erected position of the silo.

13. A mobile, self-erecting silo for storing and dispensing hot mix asphaltic concrete, comprising:

a silo main frame;

a plurality of bins supported on the silo main frame for storing and dispensing the hot mix asphaltic concrete;

silo main frame elevation means, mounted on the silo main frame, for alternatively elevating the silo main frame to a raised position wherein the silo main frame is disposed a distance above the earth's surface such that trucks can be positioned beneath the bins for receiving the hot mix asphaltic concrete and lowering the silo main frame to a lowered position thereof adjacent the earth's surface;

a conveyor pivotally mounted on the silo main frame for movement between a transport position wherein the conveyor extends longitudinally along upper portions of the silo main frame and an operating position wherein the conveyor extends at an angle from a lower end thereof at the earth's surface to an upper end thereof above the bins for receiving the hot mix asphalt at the lower end of the conveyor and discharging the hot mix asphaltic concrete at the upper end thereof;

conveyor pivotation means connected between the conveyor and the silo main frame for pivoting the conveyor between the transport and operating positions thereof; and means on the upper end of the conveyor for receiving the hot mix asphaltic concrete from the conveyor and depositing the hot mix asphaltic concrete into a selected one of the bins.

14. The silo of claim 13 further comprising conveyor support means for supporting the upper end of the conveyor in the erected position of the silo, the means for supporting the upper end of the conveyor comprising:

a conveyor lower support frame comprising a pair of laterally spaced, vertical, tubular posts positioned between a pair of vertical posts of the silo main frame;

a leg telescopingly mounted in the tubular post of each post of the conveyor lower support frame for movement into and out of the lower end of said conveyor support frame post, whereby the conveyor lower support frame can be placed in a raised position at such times that the silo main frame is placed in the raised position thereof and in a lowered position for transport of the silo;

a vertical, internally threaded tubular member within the lower end of each leg of the conveyor support means; a pair of vertical screws rotatably mounted on one of the footpads to extend into and mate with the tubular members within the legs of the conveyor support means; and a conveyor upper support frame pivotally attached to the conveyor for pivoting movement between a transport position extending along the underside of the conveyor in the transport position of the silo and a support position wherein the conveyor upper support frame rests on the conveyor lower support frame in the erected position of the silo.

15. The silo of claim 13 further comprising means for supporting the upper end of the conveyor in the erected position of the silo.

16. A silo as defined in claim 13 characterized further a detachable wheeled dolly;

means for connecting the wheeled dolly to one end of the silo in the lowered position of the silo main frame; and a fifth wheel connector mounted on the opposite end of the silo main frame for connecting the main frame to a fifth wheel of a transporting vehicle whereby the silo can be placed in an erected position for dispensing hot mix asphalt by detaching the dolly, raising the silo main frame and positioning the conveyor in the operating position and placed in a transport position for towing by a tractor having a fifth wheel by lowering the silo main frame, moving the conveyor to the transport position thereof and attaching the dolly to the silo main frame.

17. The silo of claim 13 wherein the silo main frame is characterized as comprising a plurality of vertical, tubular posts and wherein the silo main frame elevation means comprises:

a plurality of legs telescopingly mounted in the tubular posts of the silo main frame for movement into and out of the lower ends of said posts; and means for selectively extending the legs from the posts and retracting the legs into the posts.

18. The silo of claim 17 further comprising:

a plurality of footpads underlaying the telescoping legs; and means for adjustably connecting the footpads to the lower ends of the legs for vertical movement of the footpads on the legs, whereby the footpads can be lowered to the earth's surface to support the silo in the erected position thereof and raised from the earth's surface for transport of the silo in the transport position thereof.

19. The silo of claim 15 wherein the means for adjustably connecting the footpads to the lower ends of the legs comprises:

a vertical, internally threaded tubular member within the lower end of each leg; and a plurality of vertical screws rotatably mounted on the footpads to extend into and mate with the tubular members within said legs.

* * * * *
* * * * *

UNITED STATES PATENT AND TRADEMARK OFFICE

CERTIFICATE OF CORRECTION

PATENT NO. : 4,917,560

DATED : April 17, 1990

INVENTOR(S) : Murray et al.

It is certified that error appears in the above-identified patent and that said Letters Patent is hereby corrected as shown below:

| | |
|---|---|
| Column 1, Line 22 : | "maintained a" should be -- maintained at a-- |
| Column 1, Line 42 : | "dispersion" should be --dispension-- |
| Column 1, Line 68 : | "dispersion" should be --dispension-- |
| Column 3, Line 42 : | "general the" should be -- general, the-- |
| Column 5, Line 7 : | "Fig.8" should be --Fig.6-- |
| Column 5, Line 15 : | "pose" should be --post-- |
| Column 5, Line 20 : | "silo frame" should be --silo main frame-- |
| Column 5, Line 21 : | "retract" should be --retracting-- |
| Column 5, Line 22 : | "convenient of" should be -- convenient source of-- |
| Column 5, Line 23 : | "actuactor" should be --actuating-- |
| Column 5, Line 24 : | "be with" should be --be provided with-- |
| Column 5, Line 25 : | "legs extended" should be --legs in extended-- |
| Column 5, Line 26 : | "transmit" should be --transmittal-- |
| Column 5, Line 28 : | "inders" should be --cylinders-- |

UNITED STATES PATENT AND TRADEMARK OFFICE

CERTIFICATE OF CORRECTION

PATENT NO. : 4,917,560

DATED : April 17, 1990

INVENTOR(S) : Murray et al.

It is certified that error appears in the above-identified patent and that said Letters Patent is hereby corrected as shown below:

Column 5, Line 29 : "Retuning Fig.5' should be -- Returning to Fig.5--

Column 5, Line 30 : "includes 146," should be --includes footpads 146,--

Column 5, Line 31 : "lateral pairs" should be --laterally spaced pairs--

Column 5, Line 32 : "to the" should be --to support the--

Column 5, Line 33 : "for of" should be --for levelling of--

Column 6, Line 9 : "2," should be --2A and 2B--

Column 8, Line 6 : "26" should be --266--

Column 9, Line 67 : "Figures" should be --Figure--

Column 10, Line 60: "88" should be --388--

Column 11, Line 1 : "o" should be --of--

Column 13, Lines 45,46: "means a tube" should be --means comprises: a tube--

Column 14, Line 7 : "further a detachable" should be -- further to include: a detachable--

UNITED STATES PATENT AND TRADEMARK OFFICE

CERTIFICATE OF CORRECTION

PATENT NO. : 4,917,560

DATED : April 17, 1990

INVENTOR(S) : Murray et al.

It is certified that error appears in the above-identified patent and that said Letters Patent is hereby corrected as shown below:

Column 16, Line 42: "further a detachable" should be -- further to include: a detachable--

Column 18, Line 1 : "15" should be --18--

Signed and Sealed this

Twenty-eighth Day of January, 1992

*Attest:*

HARRY F. MANBECK, JR.

*Attesting Officer*

*Commissioner of Patents and Trademarks*